United States Patent [19]

Emmerich

[11] Patent Number: 4,763,956

[45] Date of Patent: Aug. 16, 1988

[54] MINING TOOL RETAINER

[75] Inventor: Kenneth C. Emmerich, Lexington, Ky.

[73] Assignee: Fansteel Inc., North Chicago, Ill.

[21] Appl. No.: 3,791

[22] Filed: Jan. 16, 1987

[51] Int. Cl.[4] ..... E21C 25/12

[52] U.S. Cl. ..... 299/86; 299/92; 299/93

[58] Field of Search ..... 299/79, 86, 91, 92, 299/93; 137/142 R, 142 A

[56] References Cited

U.S. PATENT DOCUMENTS

| | | | |
|---|---|---|---|
| 3,952,433 | 4/1976 | Heinold et al. | 37/142 A |
| 4,299,424 | 11/1981 | LeBegue et al. | 299/93 |
| 4,582,364 | 4/1986 | deMey | 299/91 X |

FOREIGN PATENT DOCUMENTS

| | | | |
|---|---|---|---|
| 2757510 | 6/1979 | Fed. Rep. of Germany | 299/93 |
| 2846743 | 4/1980 | Fed. Rep. of Germany | 299/86 |
| 2105768 | 3/1983 | United Kingdom | 299/79 |

*Primary Examiner*—Jerome Massie, IV
*Assistant Examiner*—David J. Bagnell
*Attorney, Agent, or Firm*—Barnes, Kisselle, Raisch, Choate, Whittemore & Hulbert

[57] ABSTRACT

A retainer for a mining or construction bit which bit is carried in the bore of a mounting block and which has an annular groove forming a neck at the protruding end to receive a retainer. The retainer is a split collar which snaps over the neck of the mounting portion of the bit. The collar, either a molded ring or a spring steel member, has opposed curved axial projections which are dimensioned to fit into and be retained in the bore of the mounting block during the functioning of the bit in operation.

6 Claims, 2 Drawing Sheets

MINING TOOL RETAINER

FIELD OF INVENTION

Elongate pointed bit for mining and construction retained in mounting blocks which in turn are mounted on moving chains or revolving wheels.

BACKGROUND AND OBJECTS OF THE INVENTION

Sharp pointed bits are driven mechanically and forcefully into the material to be mined or cut. These bits have a mounting shank and a coaxial working end usually fitted with a hard material such as a high grade of tungsten carbide. The mounting shank is received in an open-ended hole in a mounting block with a loose fit which allows the shank and bit to rotate as it is cutting, thus equalizing the tip wear. The mounting block is one of a series which are located in spaced relation on a revolving wheel or an endless chain which are mechanically driven in the area of the material to be mined or cut.

It is important that the bits be so mounted that the detritus from the cut material will not clog the mount to prevent rotation of the bits. The bits usually have an annular groove in the mounting end of the bit located so that the groove extends outwardly of the back end of the hole in the mounting block. A retaining ring can then be installed in the groove having a diameter larger than the hole in the block so that the bit will not leave the hole until the retainer is removed.

Various types of retainers have been used to retain bits of this type including split lock-washer type retainers, hair pin type wire retainers with spaced legs curved to encircle the groove in the bit, and hose clamp types with crossed arms which are squeezed together to enlarge the circular retainer portions for installation and removal.

It is an object of the present invention to provide a retainer which is easy to install and remove and which has a long wear life. It is a further object to provide a retainer which will absorb the shock of operation of the bits and prevent deformation of the bits which will interfere with removal. A still further object is the providing of a retainer which will freely spin and move axially on the bit during cutting operation. A still further object is to provide a retainer that can be easily installed and removed by hand, using pliers, screw driver or other suitable tools.

Another object is the provision of a hub extension or neck portion on the retainer which faces the hole of the mounting block and which will enter and lock in the block while not interfering with the rotation of the bit. An additional object of the present invention is to provide a retainer that is shock absorbent and reduces noise levels during operation.

Other objects and features of the invention will be apparent in the following description and claims in which the principles of the the invention are set forth together with details which will enable persons skilled in the art to practice the invention, all in connection with the best modes presently contemplated for the invention.

BRIEF DESCRIPTION OF THE DRAWINGS

DRAWINGS accompany the disclosure and the various views thereof may be briefly described as.

DETAILED DESCRIPTION OF THE PRINCIPLES OF THE INVENTION AND THE METHOD AND PROCESS OF USING IT

Figure 1:
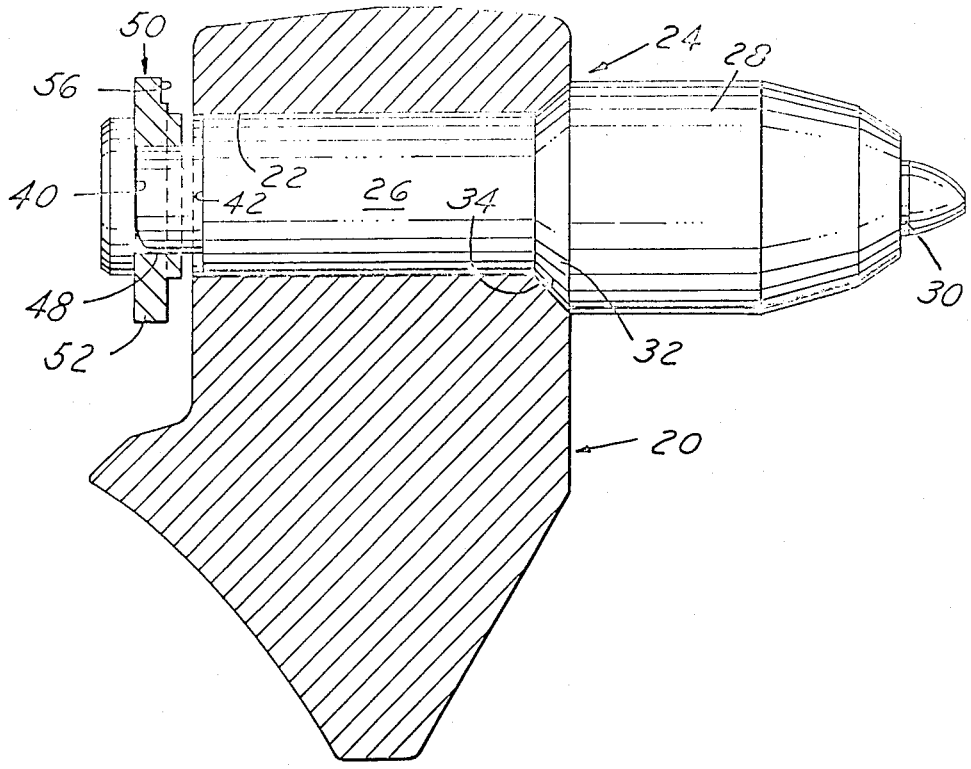
FIG. 1, a view of an assembly, partially in section, showing a bit, mounting block and retainer.
Figure 2:
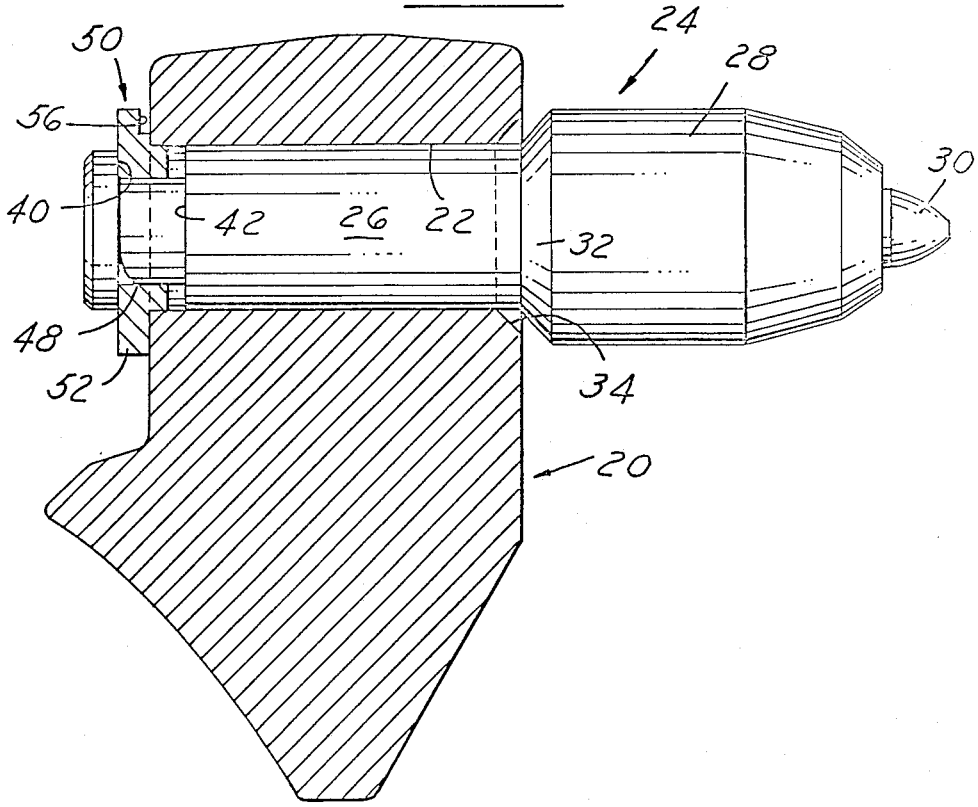
FIG. 2, a view similar to FIG. 1 showing the bit in a forward position.

With reference to the drawings in FIGS. 1 and 2, a mounting block 20 is illustrated in section. This block will be mounted on a revolving wheel or a continuous chain driven mechanically to move the block and bit assembly into the material to be mined or cut. Each block has a bore 22.

A bit 24 has a round, straight mounting shank 26 which enlarges to a working head 28 having a double tapered end in which is mounted a wear tip 30 usually made of a high grade of tungsten carbide. In the embodiment illustrated in FIGS. 1 and 2 an annular taper 32 is formed at the juncture of the shank 26 and head 28 which sockets into a complemental tapered mouth 34 at the front end of bore 22 when the bit is cutting.

At the rear or back end of the mounting shank 26 is an annular recess which terminates in opposed shoulders 40, 42 on opposite ends of a neck portion 48.

Figure 3:
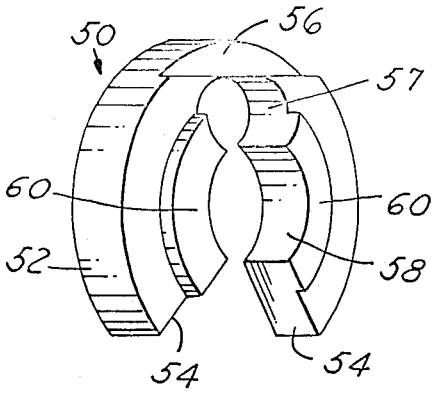
FIG. 3, a perspective view of the first embodiment of a retainer.
Figure 4:
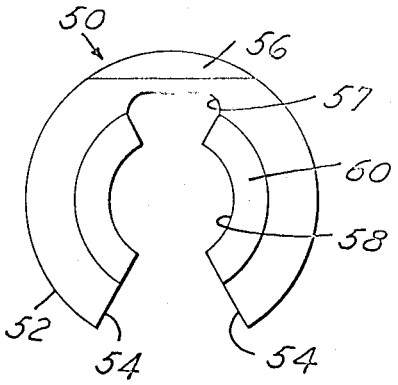
FIG. 4, a face view of the first embodiment.
Figure 5:
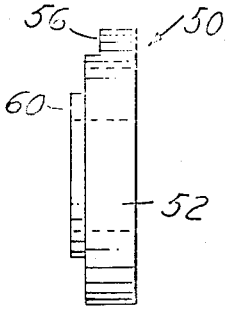
FIG. 5, a side view of the retainer of FIG. 4.

A retainer 50 is shown installed in FIGS. 1 and 2 and is shown in perspective in FIG. 3, face view in FIG. 4 and side view in FIG. 5. The retainer is a single cylindrical body 52 piece of suitable rubber or plastic material such as elastomers, (like urethane), or a thermoplastic form of polyethylene (like Hostalen GUR), with a wedge-shaped opening about 60° terminating in spaced cam walls 54. The material designated Hostalen GUR is manufactured by Hoechst Corp. of Houston, Texas. An oval ejection recess 57 is formed on the inside of the body 52 opposite the wedge-shaped opening. This recess provides a space for the introduction of a screw driver for release of the retainer and also allows the walls of the retainer to flex and thus expand more readily for installation or removal. The retainer also has a chordal flat 56 for installation or removal by means of a pliers. The center portion of the body 52 is formed with a circular recess 58 which is open to the wedge-shaped opening and extends to the essentially oval-shaped recess 57. The recess 58 preferably has an inner diameter slightly larger than the neck portion 48 of the shank between the shoulders 40 and 42.

Projecting axially from the inner face of the body 50 between the recess 57 and the wedge-shaped opening are opposed arcuate ribs 60 which have an internal diameter the same as the center recess 58. The outer diameter of the arcuate rib extensions 60 is essentially that of the inner diameter of the block bore 22 but preferably is slightly smaller.

As viewed in FIG. 1, the retainer 50 is shown installed on the neck portion 48 of the shank 26 of the bit 24 shown in the cutting position. The retainer is readily installed by forcing the wedge-shaped opening over the neck portion 48 of the bit shank between the shoulders 40 and 42. FIG. 2 shows the bit 24 in an outer position where it is flung straight forward as it breaks out of a cut. This rapid forward motion causes the shoulder 40 to move the retainer into a captive position when the ribs 60 enter the block bore 22 where they will be restricted from movement. In this position the bit can still rotate freely and the bit may still move from the cutting position as shown in FIG. 1 to the forward position as shown in FIG. 2.

It is important that the retainer does not interfere with the rotation of the bit which equalizes the tip wear and also prevents packing of dust which would limit the motion of the bit. The important function of the ribs 60 is that when they are within the block bore, they prevent any opening movement of the retainer so the retainer is securely locked in place. This occurs as the bit is flung forward out of contact with the material being cut and it is especially important that in this phase the retainer be secure.

The retainer ring protects the bit shank against deformation caused by the constant in and out motion of the bit as it moves in and out of the cut. When it is desired that the retainer be removed, a screw driver or pliers can be inserted into the oval recess 57 to pry the retainer out of the block bore or with pliers to grip on chordal flats 56.

While the ribs 60 are shown as continuous arcuate ribs, these could be interrupted as long as they are projections which enter the block bore in the forward position of the bit to restrict any opening movement of the split ring at this phase of the action.

Figure 6:
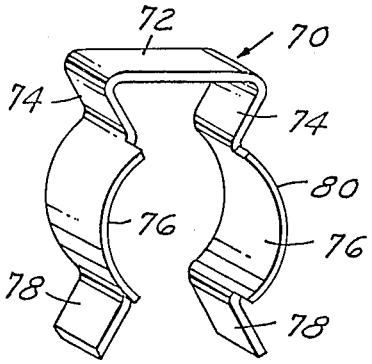
FIG. 6, a perspective view of the second embodiment of a retainer.
Figure 7:
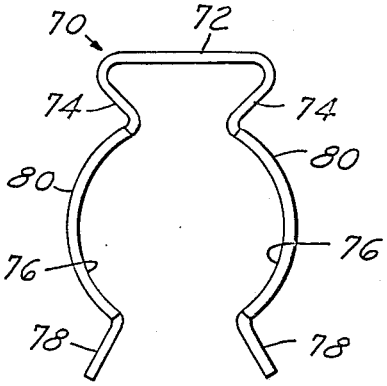
FIG. 7, an elevation of the second embodiment.
Figure 8:
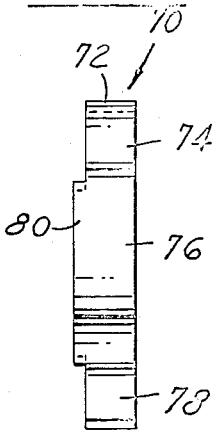
FIG. 8, a side view of the retainer of FIG. 7.

In FIGS. 6, 7 and 8, a metal retainer is illustrated in the form of a generally U-shaped sheet metal unit 70 having a flat bight 72 with converging sections 74 which terminate in spaced circular side legs 76 adjoining flared camming tips 78. The tips 78 are disposed in approximately 60° to 70° to each other. The circular leg portions 76 each have axial extension ribs 80 which are dimensioned to fit into the bore 22 of the mounting block in the forward position of the bit as illustrated in FIG. 2. Preferably the diameter of the ribs 80 will be slightly smaller than the bore 22 so they will move into the bore and be captively retained in the block. The retainer in FIGS. 6, 7 and 8 is preferably made of spring steel with a hardness of 44–48 Rockwell C scale.

Figure 9:
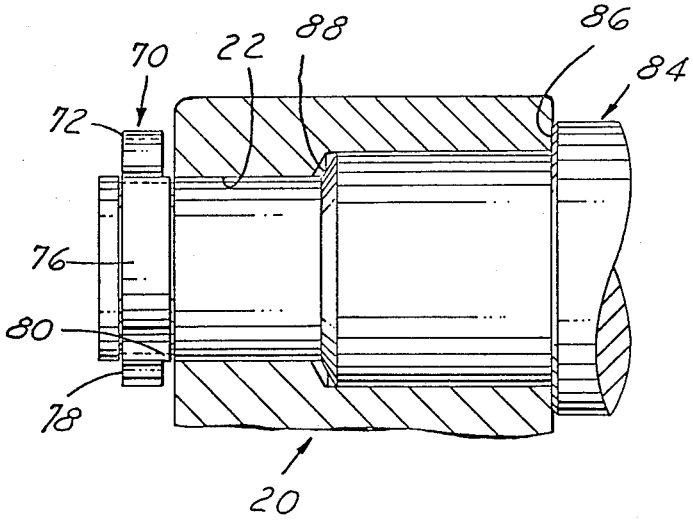
FIG. 9, a sectional view of a bit shank with a retainer installed.

In FIG. 9, a bit 84 is illustrated with a shoulder 86 which contacts an edge of the block 20. An intermediate shoulder 88 is also provided. In this embodiment the ribs 80 of retainer 70 will enter and be retained in the block bore 22 in the forward (not-cutting) position of the bit. The retainer of FIGS. 6 to 8 will also operate equally well in an embodiment similar to those of FIGS. 1 and 2.

Thus, it will be seen that the retainer serves as a shock absorber during the back and forth, in and out motion of the bits in operation but also reduces the noise of this reciprocal motion. Most importantly, the ribs of the retainer lock in the block bore when the bit is flung forward to prevent any possibility of the open-ring retainer flying off during this phase of the operation.

What is claimed is:

1. A retainer for mining or construction bits mounted in a mounting block having a receiving bore, the bits having a mounting shank received in the bore of the block and having an annular groove forming a neck portion on the end of the mounting shank extending from the bore, said retainer comprising:

(a) a body with an annular first central recess to receive and be retained on the neck portion of the mounting shank, and (b) axial extensions on said body dimensioned to be received in and be retained by said bore during operation, (c) said body being formed of a molded plastic or rubber material in a form to essentially surround the neck portion and having an opening to permit installation of the body on the bit in a motion transverse to the bit axis, and said body being formed as an annular unit having on one face circular ribs to form said extensions projecting from said face and dimensioned to fit within the bore of a mounting block while surrounding the neck portion of a bit, said annular body having a second recess open to said central recess and opposite said peripheral opening to allow said body to flex upon installation or removal of said body on said neck portion.

2. A retainer for mining or construction bits mounted in a mounting block having a receiving bore, the bits having a mounting shank received in the bore of the block and having an annular groove forming a neck portion on the end of the mounting shank extending from the bore, said retainer comprising:

(a) a body with an annular first central recess to receive and be retained on the neck portion of the mounting shank, and (b) axial extensions on said body dimensioned to be received in and be retained by said bore during operation, (c) said body being formed of a molded plastic or rubber material in a form to essentially surround the neck portion and having an opening to permit installation of the body on the bit in a motion transverse to the bit axis, and said body being formed as an annular unit having on one face circular ribs to form said extensions projecting from said face and dimensioned to fit within the bore of a mounting block while surrounding the neck portion of a bit, said body having an ejection recess on the surface facing in the same direction as said extensions to provide a space for a prying tool to release the extensions from the block bore.

3. A retainer for mining or construction bits mounted in a mounting block having a receiving bore, the bits having a mounting shank received in the bore of the block and having an annular groove forming a neck portion on the end of the mounting shank extending from the bore, said retainer comprising:

(a) a generally circular, resilient body with an inner face and an outer face larger than said bore and having an annular first central recess to receive and be retained on the neck portion of the mounting shank, said body having a radial opening from said recess to permit installation of the body on the bit in a motion transverse to the bit axis to cause temporary widening of the opening due to the resilience of the body, and (b) opposed chordal extensions on the inner face of said body on either side of said radial opening dimensioned to be received in said bore during the non-cutting phase of said bit to confine the body against dislodgment and to absorb shock of axial motion of said bit upon release from a cutting phase.

4. In combination a bit and retainer means for mining and construction which comprises:

(a) a mounting block having a receiving bore, (b) a bit having a cutting end and having a mounting shank to be received in the bore of the block and having an annular groove forming a neck portion on the end of the mounting shank extending from the bore, said bit having a radial surface at the cutting end to limit the inward movement of said bit in a cutting phase, the retainer limiting the outward movement of the bit in a non-cutting phase but permitting axial motion inward and outward between said phases, (c) said retainer comprising:

(1) a generally circular, resilient body with an inner face and an outer face larger than said bore and having an annular first central recess to receive and be retained on the neck portion of the mounting shank, said body having a radial opening from said recess to permit installation of the body on the bit in a motion installation of the body on bit axis to cause temporary widening of the opening due to the resilience of the body, and (2) opposed chordal extensions on the inner face of said body on either side of said radial opening dimensioned to be received in said bore during the non-cutting phase of said bit to confine the body against dislodgment and to absorb shock of axial motion of said bit upon release from a cutting phase.

5. A retainer for mining or construction bits mounted in a mounting block having a receiving bore, the bits having a mounting shank received in the bore of the block and having an annular groove forming a neck portion on the end of the mounting shank extending from the bore, said retainer comprising:

(a) a body with an annular first recess to receive and be retained on the neck portion of the mounting shank and having portions on an inner surface in one plane extending radially beyond the bore in the block to contact said block in one phase of an operation, (b) chordal axial extensions on said body dimensioned to be received in and be retained by said bore during a second phase of operation, (c) said body of said retainer being formed of a resilient metal in the form of an open loop, and said axial extensions are formed on said body dimensioned to enter the inner diameter of said block bore.

6. A retainer for mining or construction bits mounted in a mounting block having a receiving bore, the bits having a mounting shank received in the bore of the block and having an annular groove forming a neck portion on the end of the mounting shank extending from the bore, said retainer comprising:

(a) a body with an annular first recess to receive and be retained on the neck portion of the mounting shank and having portions on an inner surface in one plane extending radially beyond the bore in the block to contact said block in one phase of an operation, (b) chordal extensions on said body dimensioned to be received in and be retained by said bore during a second phase of operation, (c) said retainer being formed of a U-shaped spring steel member in which spaced walls in the legs of the U form the central recess, said walls being connected by a bight portion, and said legs being formed at the ends to provide an entrance opening to said recess, said chordal extensions on each said leg having a curved axial portion at said central recess with an outer diameter approximating the inner diameter of said bore.

* * * * *

UNITED STATES PATENT AND TRADEMARK OFFICE

CERTIFICATE OF CORRECTION

PATENT NO. : 4,763,956

DATED : August 16, 1988

INVENTOR(S) : Kenneth C. Emmerich

It is certified that error appears in the above-identified patent and that said Letters Patent are hereby corrected as shown below:

Col. 5, Lines 19-20, delete "installation of the body on" and insert in place thereof -- transverse to the --.

Signed and Sealed this

Seventeenth Day of January, 1989

*Attest:*

DONALD J. QUIGG

*Attesting Officer*

*Commissioner of Patents and Trademarks*